United States Patent [19]

Rioja et al.

[11] Patent Number: 5,076,859

[45] Date of Patent: Dec. 31, 1991

[54] HEAT TREATMENT OF ALUMINUM-LITHIUM ALLOYS

[75] Inventors: Roberto J. Rioja, Lower Burrell; R. Steve James, Gibsonia, both of Pa.

[73] Assignee: Aluminum Company of America, Pittsburgh, Pa.

[21] Appl. No.: 457,099

[22] Filed: Dec. 26, 1989

[51] Int. Cl.[5] ..... C22F 1/04

[52] U.S. Cl. ..... 148/12.7 A; 148/159

[58] Field of Search ..... 148/417, 12.7 A, 159

[56] References Cited

U.S. PATENT DOCUMENTS

| | | | |
|---|---|---|---|
| 3,305,410 | 2/1967 | Sublett et al. | 148/159 |
| 3,988,180 | 10/1976 | Bouvaist | 148/159 |
| 4,323,399 | 4/1982 | Dubost et al. | 148/12.7 |
| 4,812,178 | 3/1989 | Dubost | 148/12.7 |
| 4,861,391 | 8/1989 | Rioja et al. | 148/12.7 |

FOREIGN PATENT DOCUMENTS

| | | | |
|---|---|---|---|
| 158571 | 10/1985 | European Pat. Off. | 22/ |
| 707373 | 6/1981 | U.S.S.R. | 22/ |

OTHER PUBLICATIONS

Staley, J. T., "Microstructure and Toughness of High--Strength Aluminum Alloys", Properties Relates to Fracture Toughness, ASTM STP 605, 1976, pp. 71-103.

*Primary Examiner*—Deborah Yee

*Attorney, Agent, or Firm*—Andrew Alexander

[57] ABSTRACT

A method of providing a lithium containing aluminum base alloy product having, in combination, enhanced strength and fracture toughness characteristics is disclosed. The method comprises providing a worked and solution heat treated body of a lithium containing aluminum base alloy product and subjecting the product to first stage aging in a temperature range of 250° to 415° F. Further, the method comprises subjecting the worked body to a second stage aging in a temperature range of 100° to 330° F. for a time sufficient to provide the enhanced strength and fracture toughness.

53 Claims, 2 Drawing Sheets

STRENGTH / TOUGHNESS RELATIONSHIP
ALLOY 2090

STRENGTH / TOUGHNESS RELATIONSHIP
ALLOY 2090

HEAT TREATMENT OF ALUMINUM-LITHIUM ALLOYS

INTRODUCTION

This invention relates to the heat treatment of lithium-containing aluminum base alloys to provide enhanced combinational high strength and high fracture toughness properties thereto and to the improved lithium containing alloy product resulting therefrom.

BACKGROUND OF THE INVENTION

It is now well known that the provision of reduced density aluminum alloys for aircraft use can be effected through the inclusion of lithium as an alloying agent therein. The addition of lithium as an alloying agent, while desirably reducing alloy density, often results in a decrease in ductility and fracture toughness. Where aircraft use is contemplated, it is imperative that lithium-containing alloys have both improved fracture toughness and strength properties.

It will be appreciated that both high strength and high fracture toughness appear to be quite difficult to obtain when viewed in light of conventional alloys such as AA (Aluminum Association) 2024-T3X and 7050-TX normally used in aircraft applications. For example, a paper by J. T. Staley entitled "Microstructure and Toughness of High-Strength Aluminum Alloys", Properties Related to Fracture Toughness, ASTM STP6055, American Society for Testing and Mateials 1976, pp. 71–103, shows generally that for AA2024 sheet, toughness decreases as strength increases. Also, in the same paper, it will be observed that the same is true of AA7050 plate. More desirable alloys would permit increased strength with only minimal or no decrease in toughness or would permit processing steps wherein the toughness was controlled as the strength was increased in order to provide a more desirable combination of strength and toughness.

Attaining the combination of both high strength and high fracture toughness in an aluminum-lithium alloy having density reduction in the order of 5 to 15% has been a recognized objective in this art for a number of years. Such lithium-containing alloys would be of significant utility in the aircraft and aerospace industries where low weight, high strength and high fracture toughness translate to high fuel savings and other design economies.

Prior approaches directed toward such a desirable objective have included variations in thermal, mechanical and thermomechanical processing of lithium-containing alloys. One of such areas of endeavor has been the employment of modified aging treatments and particularly in the employment of multiple aging techniques. Exemplary thereof are U.S. Pat. Nos. 4,812,178, 4,323,399, European Application 0158571Al and USSR patent 703,373.

SUMMARY OF THE INVENTION

This invention may be briefly described as an improved thermal treatment for lithium-containing aluminum base alloys to provide high strength with minimal or little sacrifice in toughness. In a broad aspect, the invention includes a multiple step aging treatment and subsequent to solution heat treatment for lithium containing aluminum base alloys and wherein the alloy is sequentially subjected to high temperature aging for a short time period followed by a low temperature aging for a substantially longer period of time. In a narrower aspect, the invention includes a post solution heat treatment multiple aging practice for lithium-containing aluminum-base alloys that includes a first step short time period aging within a temperature range of 250° to 415° F. followed by a second step aging for longer periods of time within a temperature range of 100° to 330° F., preferably 100° to 275° F.

Among the advantages of the subject invention is the provision of improved lithium-containing aluminum base alloys with enhanced combinational high strength and high fracture toughness characteristics and an economic process to attain such characteristics.

The object of this invention is the provision of an improved process for heat treating lithium-containing aluminum base alloy products to enhance combinational high strength and high fracture toughness properties thereof.

Another object of this invention is to provide an improved two step aging process for enhancing the combinational strength and fracture toughness characteristics of lithium-containing aluminum base alloy products.

A further object of this invention is to provide improved lithium-containing aluminum base alloy products characterized by a combination of enhanced strength and fracture toughness.

Other objects and advantages of this invention will become apparent from the following portions of this disclosure and from the appended drawings which illustrate, in accord with the mandate of the patent statutes, presently preferred temperature and time parameters that incorporate the principle of this invention.

DETAILED DESCRIPTION OF THE INVENTION

Figure 1:
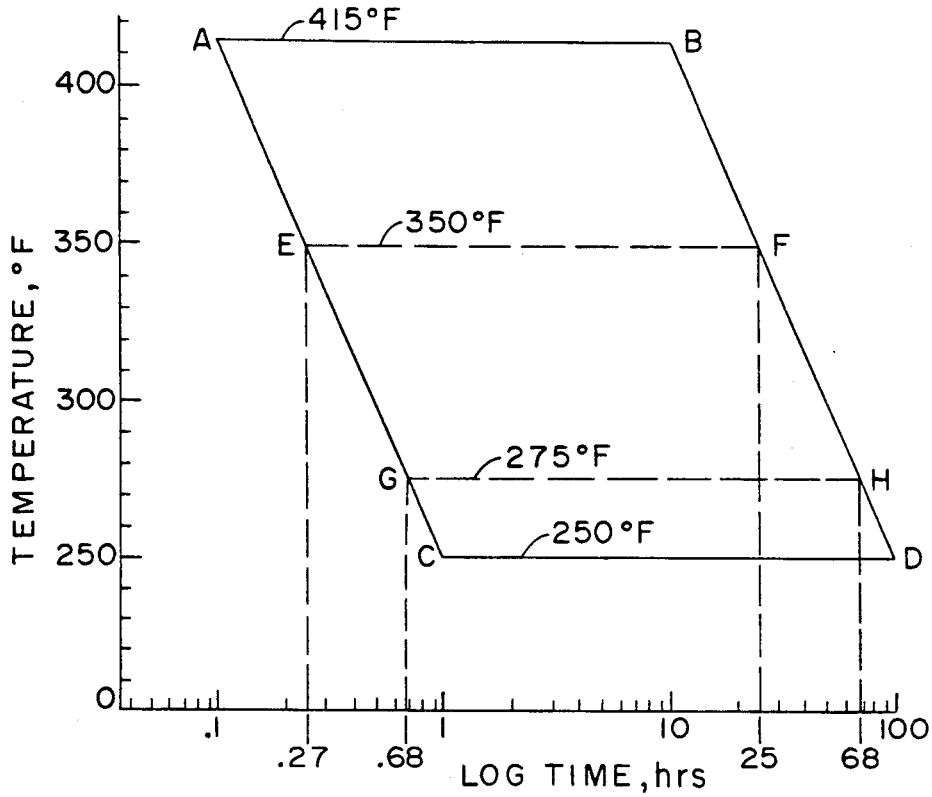
FIG. 1 sets forth the general and preferred ranges for the first step high temperature aging operation for lithium-containing aluminum base alloys.

Illustrative lithium-containing aluminum base alloys to which the subject invention relates can contain 0.2 to 5.0 wt. % Li, 0 to 5.0 wt. % Mg, up to 5.0 wt. % Cu, 0 to 2 wt. % Ag, 0 to 1.0 wt. % Zr, 0 to 1.0 wt. % Mn, 0 to 9.0 wt. % Zn, 0.5 wt. % max. Fe, 0.5 wt. % max. Si, the balance aluminum and incidental impurities. The impurities are preferably limited to about 0.25 wt. % each, and the combination of impurities preferably should not exceed 0.5 wt. %. Within these limits, it is preferred that the sum total of all impurities does not exceed 0.5 wt. %.

Suitably, the alloys of the present invention desirably contain 0.5 to 4.0 wt. % Li, 0.1 to 6.0 wt. % Mg, at least 0.6 wt. % Cu, 0.05 to 12 wt. % Zn, 0 to 0.8 wt. % Mn, 0.15 wt. % max. Zr, 0.05 to 1 wt. % Ag, 0.5 wt. % max. Fe, 0.5 wt. % max. Si, the balance aluminum and incidental impurities. Typically, an alloy in accordance with the present invention can contain 1.0 to 3.0 wt. % Li, 0.6 to 4.0 wt. % Cu, 0.2 to 2.5 wt. % Mg, 0.2 to 11 wt. % Zn, 0.2 to 0.8 wt. % Ag, 0.1 to 0.8 wt. % Mn, the balance aluminum and incidental impurities as specified above. A typical alloy composition would contain 1.8 to 2.5 wt. % Li, 2.50 to 2.9 wt. % Cu, 0.05 to 2.0 wt. % Mg, 0.2 to 2.0 wt. % Zn, 0.1 to 0.7 wt. % Mn, 0.15 wt. % max. Zr, and 0.3 wt. % max. each of Fe and Si.

Another suitable alloy composition would contain 1.9 to 2.4 wt. % Li, 2.55 to 2.9 wt. % Cu, 0.1 to 0.6 wt. % Mg, 0.5 to 1.0 wt. % Zn, 0.1 to 0.7 wt. % Mn, max. 0.15 wt. wt. % Zr, and max. 0.25 wt. % of each of Fe and Si, the remainder aluminum and incidental impurities.

As previously pointed out, lithium not only permits a significant decrease in overall alloy density but also markedly improves tensile and yield strengths as well as improving elastic modulus. Additionally, the presence of lithium improves fatigue resistance. Most significantly though, the presence of lithium in combination with other controlled amounts of alloying elements permits the fabrication of aluminum alloy products which can be worked to provide unique combinations of strength and fracture toughness while maintaining meaningful reductions in density. It will be appreciated that less than 0.5 wt. % Li does not provide for significant reductions in the density of the alloy and 4 wt. % Li is close to the solubility limit of lithium, depending to a significant extent on the other alloying elements.

The lithium-containing aluminum base alloys herein of interest are all of the "heat treatable" type wherein solution heat treatment of a wrought or other formed product followed by rapid quenching renders, at least for a short time, the alloy product easily workable. The herein-described sequential heat treatments are designed to follow conventional solution heat treatment and quenching and, if desired, to follow further cold working of the quenched product to further raise the mechanical properties of the alloy product and to provide for the combinational characteristic of high strength and high fracture toughness. The product may be provided as sheet or plate, extruded or forged product.

Such solution heat treatment of the lithium-containing aluminum base alloy product can be performed in batches or continuously, and the time for such treatment can vary from hours for batch treatment to relatively short times. Such solution heat treatment is that conventionally employed for lithium-containing aluminum base alloy products and can be accomplished at a temperature in the range of 900 to 1050° F. Such solution heat treatment is immediately followed by rapid quenching to prevent or minimize uncontrolled precipitation of strengthening phases in the alloy. Preferred quenching serves to reduce the product temperature at a rate of about 100 to 200° F per second from solution heat treatment temperature to less than 200° F. Further cold working, subsequent to solution heat treatment, can be, where appropriate, cold working of sheet stock, e.g., cold rolling or stretching.

After solution heat treatment and quenching of the lithium-containing aluminum alloy product and possible supplemental cold working as described above is completed, the product is selectively subjected to the multiple stage aging process as herein disclosed to provide enhanced high strength with minimal or little sacrifice in toughness.

Such multiple aging process for lithium-containing aluminum alloy product includes a first stage high temperature short term aging operation followed by a second stage low temperature and longer term aging. The first stage aging operation suitably includes subjecting a worked product to a temperature in the range of 250° to 425° F. for a period of time in the range of 0.1 to 100 hours and preferably in the range of 275° to 350° F. for a period of tie in the range of 1 to 50 hours. Such first stage heat treatment is followed by a second stage heat treatment wherein the worked product is subjected to a temperature in the range of 100° to 330 ° F. and preferably 100° to 275° F., and typically 150° to 250 ° F. for a period of time ranging from 1 to 1000 hours.

More precisely, the first step aging operation is suitably carried out in a temperature-time range in the form of a parallelogram, as shown in FIG. 1, and the corners of which, on a temperature (°F)-log time graph, are of the following coordinates:

| | °F. | Hrs. |
|---|---|---|
| A | 425 | .1 |
| B | 425 | 10 |
| C | 250 | 1 |
| D | 250 | 100 and preferably |
| E | 350 | 0.27 |
| F | 350 | 25 |
| G | 275 | 0.68 |
| H | 275 | 68 |

Figure 2:
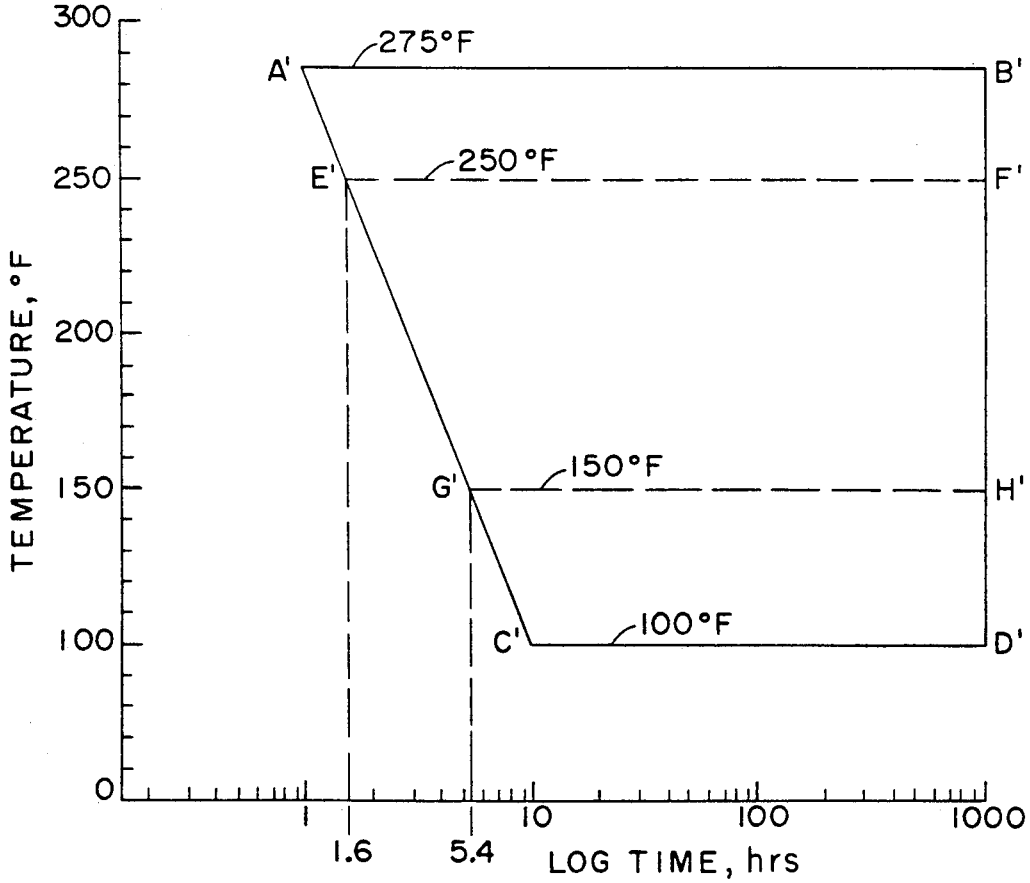
FIG. 2 sets forth the general and preferred ranges for the second step low temperature aging operation.

In a similar manner, the second stage aging operation is suitably carried out in a temperature-time range in the form of an open ended parallelogram, as shown in FIG. 2, and the corners of which, on a temperature (° F)-log time graph, are of the following coordinates:

| | °F. | Hrs. |
|---|---|---|
| A' | 275 | 1 |
| B' | 275 | 1000 or greater |
| C' | 100 | 10 |
| D' | 100 | 1000 or greater |
| E' | 250 | 1.6 |
| F' | 250 | 1000 or greater |
| G' | 150 | 5.4 |
| H' | 150 | 1000 or greater |

Figure 3:
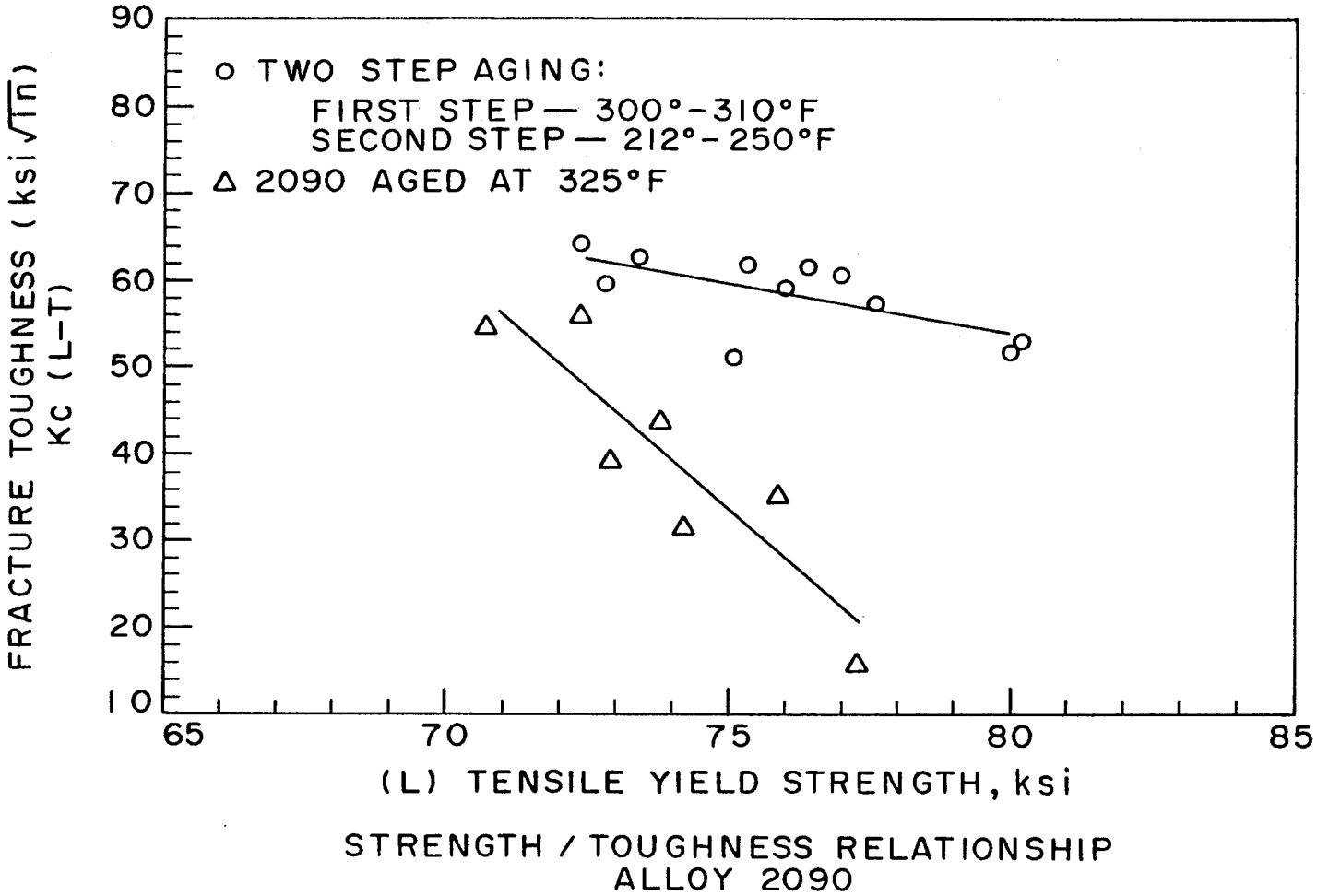
FIG. 3 graphically depicts the yield strength fracture toughness for alloys 2090 (aged at 310° for 16 to 24 hours or 300° F. for 16 to 28 hours) resulting from the practice of this invention. This figure also shows the properties from the same alloy aged at 325° F.

FIG. 3 graphically depicts the improvement in combinational high yield strength (KSI) and high fracture toughness (KSI√in) that is obtainable from the practice of this invention. As is there apparent, the two step aging practice, as applied to 2090 (aged at 310° F. for 16 to 24 hours) and 2090 (aged at 300° F. for 16 to 28 hours) with second stage aging in the range of 180° to 250° F. for periods of time ranging from 20 to 1000 hours provided significantly higher fracture toughness values for equivalent elevated yield stress values as the latter was conventionally defined for 2090 aged at 325° F in a single step aging practice. Tables I and II show the properties obtained after single and two step aging practices, respectively, for 2090.

TABLE I

Mechanical Properties of 2090 Sheet Aged at 325° F.

| Thick (in.) | S-No. | Trans. Lot No. | Parent Lot No. | Tensile Ultimate Strength L | L-T | 45 | Tensile Yield Strength L | L-T | 45 | Elongation % in 2 in. L | L-T | 45 | Toughness L-T $K_c$ | L-T $K_{app}$ | T-L $K_c$ | T-L $K_{app}$ |
|---|---|---|---|---|---|---|---|---|---|---|---|---|---|---|---|---|
| 0.039 | 589764 | 109-844 | 486-911 | 80.8 | 76.2 | 68.3 | 72.4 | 68.7 | 59.0 | 5.0 | 7.5 | 11.0 | 56.4 | 40.3 | 31.8 | 30.6 |
| 0.040 | 589790 | 109.599 | | 79.2 | 74.2 | 65.8 | 71.1 | 66.9 | 57.6 | 5.0 | 8.0 | 8.5 | | | | |
| 0.047 | 589766 | 109-846 | 486-901 | 82.8 | 77.8 | 68.6 | 74.2 | 71.6 | 59.3 | 5.5 | 5.0 | 10.5 | 32.2 | 30.4 | 45.7 | 33.7 |
| 0.048 | 589789 | | 486-931 | 84.6 | 79.4 | 70.9 | 75.9 | 72.8 | 62.6 | 5.0 | 6.5 | 11.5 | 35.8 | 33.1 | — | — |
| 0.059 | 589762 | 109-681 | 243-091 | 79.9 | 76.2 | 66.8 | 73.8 | 70.9 | 61.6 | 6.5 | 8.5 | 10.5 | 44.2 | 35.8 | — | — |
| 0.062 | 589768 | 109-849 | 486-891 | 81.4 | 78.4 | 70.6 | 72.9 | 71.8 | 62.4 | 4.5 | 6.0 | 10.5 | 39.8 | 36.1 | 36.7 | 35.2 |
| 0.069 | 589776 | 109-852 | 486-892 | 83.9 | 80.5 | 70.9 | 75.1 | 71.8 | 62.4 | 4.5 | 7.0 | 10.5 | | | | |
| 0.077 | 589777 | 109-857 | 486-922 | 86.6 | 81.1 | 73.6 | 80.3 | 76.0 | 66.4 | 6.0 | 5.0 | 10.5 | | | | |
| 0.080 | 589770 | 109-854 | 486-921 | 85.4 | 82.7 | 74.7 | 77.3 | 76.4 | 68.0 | 5.0 | 6.5 | 8.5 | 16.4 | 16.4 | 17.5 | 17.5 |
| 0.086 | 589763 | 109-682 | 243-081 | 78.7 | 76.0 | 67.3 | 72.5 | 70.7 | 62.8 | 8.5 | 8.5 | 11.0 | 55.0 | 50.5 | 30.9 | 29.8 |
| 0.101 | 589787 | 109-781 | | 81.7 | 78.1 | 69.8 | 72.4 | 69.6 | 59.0 | 5.5 | 7.0 | 12.0 | | | | |
| 0.125 | 589783 | 109-568 | | 82.4 | 78.8 | 71.9 | 74.3 | 70.9 | 62.4 | 4.5 | 7.5 | 10.5 | | | | |

Notes:
1. All strengths in ksi units.
2. Yield strengths obtained by 0.2% offset method.
3. L = Longitudinal
4. L-T = Long Transverse.
5. 45 = 45 Degree angle from rolling direction.
6. Toughness in ksi $\sqrt{\text{in.}}$

TABLE II

Alloy 2090 Aged at 300° F. Followed by Agings at 212° F. and 250° F.

| Orientation | | 1000 Hours at 212° F. TYS | UTS | % El | 50 Hours at 250°0 F. TYS | UTS | % El | 168 Hours at 212° F. TYS | UTS | % El | 1000 Hours at 212° F. TYS | UTS | % El | 50 Hours at 250° F. TYS | UTS | % El |
|---|---|---|---|---|---|---|---|---|---|---|---|---|---|---|---|---|
| Tensile* Properties | L | 80.2 | 90.2 | 5.5 | 75.3 | 82.6 | 5.5 | 72.4 | 83.4 | 3.5 | 78.4 | 91.1 | 7.0 | 72.0 | 82.9 | 4.0 |
| | LT | 70.7 | 82.6 | 11.0 | 65.2 | 73.1 | 10.0 | 65.8 | 79.3 | 8.0 | 72.0 | 84.8 | 10.0 | 66.4 | 78.2 | 8.0 |
| | 45° | 51.7 | 58.2 | 15.0 | 56.2 | 65.3 | 12.0 | 54.1 | 69.3 | 15.0 | 59.2 | 73.0 | 15.0 | 53.2 | 68.5 | 15.0 |
| Fracture** Toughness | L-T | 52.0 | | | 61.9 | | | | | | 47.2 | | | | | |
| | Kc | | | | | | | | | | | | | | | |
| | Kapp | 48.0 | | | 58.2 | | | | | | 45.0 | | | | | |

| Orientation | | TYS | UTS | % El | TYS | UTS | % El | TYS | UTS | % El | 168 Hours at 212° F. TYS | UTS | % El | 300 Hours at 212°0 F. TYS | UTS | % El |
|---|---|---|---|---|---|---|---|---|---|---|---|---|---|---|---|---|
| Tensile* Properties | L | 73.0 | 77.4 | 6.5 | 76.0 | 80.4 | 8.0 | 73.4 | 78.4 | 8.0 | 77.6 | 84.0 | 3.0 | 77.2 | 84.5 | 3.4 |
| | LT | 75.7 | 81.6 | 6.0 | 77.9 | 84.0 | 7.0 | 78.3 | 83.2 | 12.0 | 64.6 | 75.9 | 9.0 | 66.3 | 78.7 | 9.0 |
| | 45° | 65.4 | 74.8 | 14.0 | 67.5 | 76.7 | 13.0 | 67.4 | 76.0 | 14.0 | 56.2 | 69.5 | 12.0 | 57.3 | 70.4 | 11.0 |
| Fracture** Toughness | L-T | 62.3 | | | 59.2 | | | 62.9 | | | 57.6 | | | | | |
| | Kc | | | | | | | | | | | | | | | |
| | Kapp | 49.7 | | | 46.7 | | | 50.9 | | | 50.5 | | | | | |

| Orientation | | 1000 Hours at 212° F. TYS | UTS | % El | 20 Hours at 212° F. TYS | UTS | % El | 50 Hours at 250° F. TYS | UTS | % El |
|---|---|---|---|---|---|---|---|---|---|---|
| Tensile* Properties | L | 80.0 | 87.0 | 8.0 | 76.4 | 82.3 | 3.5 | 77.0 | 84.1 | 3.5 |
| | LT | 70.9 | 78.3 | 11.0 | 62.3 | 75.0 | 8.0 | 65.2 | 77.6 | 9.0 |
| | 45° | 61.9 | 70.0 | 13.0 | 54.7 | 68.5 | 13.0 | 59.1 | 71.1 | 10.0 |
| Fracture** Toughness | L-T | 53.2 | | | 61.1 | | | 60.8 | | |
| | Kc | | | | | | | | | |
| | Kapp | 48.2 | | | 57.1 | | | 55.7 | | |

*ksi

**ksi $\sqrt{\text{in}}$

Having thus described the invention what is claimed is:

1. A method of providing a lithium containing aluminum base alloy product having, in combination, enhanced strength and fracture toughness characteristics, comprising:

(a) providing a worked and solution heat treated body of a lithium containing aluminum base alloy product;

(b) subjecting said product to a higher firs stage aging in a temperature range of 250° to 415° F.; and (c) subjecting said worked body to a lower second stage aging in a temperature range of 100° to 330° F. for a time sufficient to provide said enhanced strength and fracture toughness, the second stage aging starting at a temperature lower than the starting temperature of the higher first stage aging.

2. The method in accordance with claim 1 wherein the temperature range in the first stage is 275° to 350° F.

3. The method in accordance with claim 1 wherein the temperature range in the second stage is 100° to 275° F.

4. The method in accordance with claim 1 wherein in the first stage aging is carried out for 0.1 to 100 hours.

5. The method in accordance with claim 1 wherein in the first stage aging is carried out for 0.27 to 25 hours.

6. The method in accordance with clam 1 wherein in the second stage aging is carried out for at least one-half hour.

7. The method in accordance with claim 1 wherein in the second stage aging is carried out for at least 1 hour.

8. The method in accordance with claim 1 wherein second stage aging is carried out for a time in the range of 1 to 1000 hours.

9. The method in accordance with claim 1 wherein second stage aging is carried out for a time in the range of 10 to 1000 hours.

10. A method of providing a lithium containing aluminum base alloy product having, in combination, enhanced strength and fracture toughness characteristics, comprising:

(a) providing a worked and solution heat treated body of a lithium containing aluminum base alloy product;

(b) subjecting said product to a higher first stage aging in a temperature range of 250° to 415° F. for a period of time in the range of 0.1 to 100 hours; and (c) subjecting said worked body to a lower second stage aging in a temperature range of 100° to 275° F. for at least one hour to provide said enhanced strength and fracture toughness, the second stage aging starting at a temperature lower than the starting temperature of the higher first stage aging.

11. A method of providing a lithium containing aluminum base alloy product having, in combination, enhanced strength and fracture toughness characteristics, comprising:

(a) providing a worked and solution heat treated body of a lithium containing aluminum base alloy product;

(b) subjecting said product to a higher first stage aging in a temperature range of 275° to 350° F. for a period of time in the range of 0.1 to 100 hours; and (c) subjecting said worked body to a lower second stage aging in a temperature range of 100° to 275° F. for a period of time in the range of 1 to 1000 hours to provide said enhanced strength and fracture toughness.

12. The method in accordance with claim 11 wherein said second stage aging is carried out in a temperature range of 150° to 250° F.

13. A method of providing lithium containing aluminum base alloy product having, in combination, enhanced strength and fracture toughness characteristics, comprising:

(a) providing a worked and solution heat treated body of an aluminum base alloy product comprised of 0.2 to 5.0 wt. % Li, 0 to 5.0 wt. % Mg, up to 5.0 wt. % Cu, 0 to 2 wt. % Ag, 0 to 1.0 wt. % Zr, 0 to 1.0 wt. % Mn, 0 to 9.0 wt. % Zn, 0.5 wt. % max. Fe, 0.5 wt. % max, Si, the balance aluminum and incidental impurities;

(b) subjecting said product to a higher first stage aging in a temperature range of 250° to 415° F.; and (c) subjecting said worked body to a lower second stage aging in a temperature range of 100° to 275° F. for a time sufficient to provide said enhanced strength and fracture toughness, the second stage aging starting at a temperature lower than the starting temperature of the higher first stage aging.

14. The method in accordance with claim 13 wherein Li is in the range of 0.5 to 4 wt. %.

15. The method in accordance with claim 13 wherein Mg is in the range of 0.1 to 6 wt. %.

16. The method in accordance with claim 13 wherein Cu is in the range of 0.6 to 5 wt. %.

17. The method in accordance with claim 13 wherein Zn is in the range of 0.05 to 12 wt. %.

18. The method in accordance with claim 13 wherein Mn is 0.8 wt. % max.

19. The method in accordance with claim 13 wherein Ag is in the range of 0.05 to 1 wt. %.

20. The method in accordance with claim 13 wherein Zr is 0.15 wt. % max.

21. A method of providing a lithium containing aluminum base alloy product having, in combination, enhanced strength and fracture toughness characteristics, comprising:

(a) providing a worked and solution heat treated body of an aluminum base alloy product comprised of 0.5 to 4.0 wt. % Li, 0.1 to 6.0 wt. % Mg, at least 0.6 wt. % Cu, 0.05 to 12 wt. % Zn, 0 to 0.8 wt. % Mn, 0.15 wt. % max. Zr, 0.05 to 1 wt. % Ag, 0.5 wt. % max. Fe, 0.5 wt. % max. Si, the balance aluminum and incidental impurities;

(b) subjecting said product to a higher first stage aging in a temperature range of 250° to 415° F.; and (c) subjecting said worked body to a lower second stage aging in a temperature range of 100° to 275° F. for a time sufficient to provide said enhanced strength and fracture toughness, the second stage aging starting at a temperature lower than the starting temperature of the higher first stage aging.

22. The method in accordance with claim 21 wherein Li is in the range of 1.0 to 3 wt. %.

23. The method in accordance with claim 21 wherein Mg is in the range of 0.2 to 2.5 wt. %.

24. The method in accordance with claim 21 wherein Cu is in the range of 0.6 to 4 wt. %.

25. The method in accordance with claim 21 wherein Zn is in the range of 0.2 to 11 wt. %.

26. The method in accordance with claim 21 wherein Ag is in the range of 0.2 to 0.8 wt. %.

27. The method in accordance with claim 21 wherein Mn is in the range of 0.1 to 0.8 wt. %.

28. A method of providing a lithium containing aluminum base alloy product having, in combination, enhanced strength and fracture toughness characteristics, comprising:

(a) providing a worked and solution heat treated body of an aluminum base alloy product comprised of 1.0 to 3.0 wt. % Li, 0.6 to 4.0 wt. % Cu, 0.2 to 2.5 wt. % Mg, 0.2 to 11 wt. % Zn, 0.2 to 0.8 wt. % Ag, 0.1 to 0.8 wt. % Mn, the balance aluminum and incidental impurities;

(b) subjecting said product to a higher first stage aging in a temperature range of 250° to 415° F.; and (c) subjecting said worked body to a lower second stage aging in a temperature range of 100° to 275° F. for a time sufficient to provide said enhanced strength and fracture toughness, the second stage aging starting at a temperature lower than the starting temperature of the higher first stage aging.

29. The method in accordance with claim 28 wherein Li is in the range of 1.8 to 2.5 wt. %.

30. The method in accordance with claim 28 wherein Mg is in the range of 0.05 to 2 wt. %.

31. The method in accordance with claim 28 wherein Cu is in the range of 2.5 to 2.9 wt. %.

32. The method in accordance with claim 28 wherein Zn is in the range of 0.2 to 2 wt. %.

33. The method in accordance with claim 28 wherein Mn is in the range of 0.1 to 0.7 wt. %.

34. A method of providing a lithium containing aluminum base alloy product having, in combination, enhanced strength and fracture toughness characteristics, comprising:

(a) providing a worked and solution heat treated body of an aluminum base alloy product comprised of 1.8 to 2.5 wt. % Li, 2.50 to 2.9 wt. % Cu, 0.05 to 2.0 wt. T Mg, 0.2 to 2.0 wt. % Zn, 0.1 to 0.7 wt. % Mn, 0.15 wt. % max. Zr, and 0.3 wt. % max. each of Fe and Si;

(b) subjecting said product to a higher first stage aging in a temperature range of 250° to 415° F.; and (c) subjecting said worked body to a lower second stage aging in a temperature range of 100° to 275° F. for a time sufficient to provide said enhanced strength and fracture toughness, the second stage aging starting at a temperature lower than the starting temperature of the higher first stage aging.

35. A method of providing a lithium containing aluminum base alloy product having, in combination, enhanced strength and fracture toughness characteristics, comprising:

(a) providing a worked and solution heat treated body of an aluminum base alloy product comprised of 1.9 to 2.4 wt. % Li, 2.55 to 2.9 wt. % Cu, 0.1 to 0.6 wt. % Mg, 0.5 to 1.0 wt. % Zn, 0.1 to 0.7 wt. % Mn, max. 0.15 wt. wt. % Zr, and max. 0.25 wt. % of each of Fe and Si, the remainder aluminum and incidental impurities;

(b) subjecting said product to a higher first stage aging in a temperature range of 250° to 415° F.; and (c) subjecting said worked body to a lower second stage aging in a temperature range of 100° to 275° F. for a time sufficient to provide said enhanced strength and fracture toughness, the second stage aging starting at a temperature lower than the starting temperature of the higher first stage aging.

36. A method of providing a lithium containing aluminum base alloy product having, in combination, enhanced strength and fracture toughness characteristics, comprising:

(a) providing a worked and solution heat treated body of an aluminum base alloy product comprised of 0.2 to 5.0 wt. % Li, 0 to 5.0 wt. % Mg, up to 5.0 wt. % Cu, 0 to 2 wt. % Ag, 0 to 1.0 wt. % Zr, 0 to 1.0 wt. % Mn, 0 to 9.0 wt. % Zn, 0.5 wt. % max. Fe, 0.5 wt. % max. Si, the balance aluminum and incidental impurities;

(b) subjecting said product to a higher first stage aging in a temperature range of 275° to 350° F. for a period of time in the range of 0.1 to 100 hours; and (c) subjecting said worked body to a lower second stage aging in a temperature range of 100° to 275° F. for a period of time in the range of 1 to 1000 hours to provide said enhanced strength and fracture toughness.

37. A method of providing a lithium containing aluminum base alloy product having, in combination, enhanced strength and fracture toughness characteristics, comprising:

(a) providing a worked and solution heat treated body of an aluminum base alloy product comprised of 0.5 to 4.0 wt. % Li, 0.1 to 6.0 wt. % Mg, at least 0.6 wt. % Cu, 0.05 to 12 wt. % Zn, 0 to 0.8 wt. % Mn, 0.15 wt. % max. Zr, 0.05 to 1 wt. % Ag, 0.5 wt. % max. Fe, 0.5 wt. % max. Si, the balance aluminum and incidental impurities;

(b) subjecting said product to a higher first stage aging in a temperature range of 275° to 350° F. for a period of time in the range of 0.1 to 100 hours; and (c) subjecting said worked body to a lower second stage aging in a temperature range of 100 to 275° F for a period of time in the range of 1 to 1000 hours to provide said enhanced strength and fracture toughness.

38. A method of providing a lithium containing aluminum base alloy product having, in combination, enhanced strength and fracture toughness characteristics, comprising:

(a) providing a worked and solution heat treated body of an aluminum base alloy product comprised of 1.0 to 3.0 wt. % Li, 0.6 to 4.0 wt. % Cu, 0.2 to 2.5 wt. % Mg, 0.2 to 11 wt. % Zn, 0.2 to 0.8 wt. % Ag, 0.1 to 0.8 wt. % Mn, the balance aluminum and incidental impurities;

(b) subjecting said product to first stage aging in a temperature range of 275° to 350° F. for a period of time in the range of 0.1 to 100 hours; and (c) subjecting said worked body to a lower second stage aging in a temperature range of 100° to 275° F. for a period of time in the range of 1 to 1000 hours to provide said enhanced strength and fracture toughness.

39. A method of providing a lithium containing aluminum base alloy product having, in combination, enhanced strength and fracture toughness characteristics, comprising:

(a) providing a worked and solution heat treated body of an aluminum base alloy product comprised of 1.8 to 2.5 wt. % Li, 2.50 to 2.9 wt. % Cu, 0.05 to 2.0 wt. % Mg, 0.2 to 2.0 wt. % Zn, 0.1 to 0.7 wt. % Mn, 0.15 wt. % max. Zr, and 0.3 wt. % max. each of Fe and Si;

(b) subjecting said product to a higher first stage aging in a temperature range of 275° to 350° F. for a period of time in the range of 0.1 to 100 hours; and (c) subjecting said worked body to a lower second stage aging in a temperature range of 100° to 275° F. for a period of time in the range of 1 to 1000 hours to provide said enhanced strength and fracture toughness.

40. A method of providing a lithium containing aluminum base alloy product having, in combination, enhanced strength and fracture toughness characteristics, comprising:

(a) providing a worked and solution heat treated body of an aluminum base alloy product comprised of 1.9 to 2.4 wt. % Li, 2.55 to 2.9 wt. % Cu, 0.1 to 0.6 wt. % Mg, 0.5 to 1.0 wt. % Zn, 0.1 to 0.7 wt. % Mn, max. 0.15 wt. % Zr, and max. 0.25 wt. % of each of Fe and Si, the remainder aluminum and incidental impurities;

(b) subjecting said product to a higher first stage aging in a temperature range of 275° to 350° F. for a period of time in the range of 0.1 to 100 hours; and (c) subjecting said worked body to a lower second stage aging in a temperature range of 100° to 275° F. for a period of time in the range of 1 to 1000 hours to provide said enhanced strength and fracture toughness.

41. In a method of providing a lithium containing aluminum base alloy flat rolled product for air or spacecraft applications, the improvement wherein the product has, in combination, enhanced strength and fracture toughness characteristics, said product resulting from:

(a) providing a worked and solution heat treated body of a lithium containing aluminum base alloy product;

(b) subjecting said product to a higher first stage aging in a temperature range of 250° to 415° F.; and (c) subjecting said worked body to a lower second stage aging in a temperature range of 100° to 330° F. for a time sufficient to provide said enhanced strength and fracture toughness, the second stage aging starting at a temperature lower than the starting temperature of the higher first stage aging.

42. In a method of providing a lithium containing aluminum base alloy flat rolled product for air or spacecraft applications, the improvement wherein the product has, in combination, enhanced strength and fracture toughness characteristics, said product resulting from:

(a) providing a worked and solution heat treated body of a lithium containing aluminum base alloy product;

(b) subjecting said product to a higher first stage aging in a temperature range of 275° to 350° F. for a period of time in the range of 0.1 to 100 hours; and (c) subjecting said worked body to a lower second stage aging in a temperature range of 100° to 275° F. for a period of time in the range of 1 to 1000 hours to provide said enhanced strength and fracture toughness.

43. A method of providing a lithium containing aluminum base alloy flat rolled product for air or spacecraft applications, the improvement wherein the product has, in combination, enhanced strength and fracture toughness characteristics, said product resulting from:

(a) providing a worked and solution heat treated body of an aluminum base alloy product comprised of 0.2 to 5.0 wt. % Li, 0 to 5.0 wt. % Mg, up to 5.0 wt. % Cu, 0 to 2 wt. % Ag, 0 to 1.0 wt. % Zr, 0 to 1.0 wt. % Mn, 0 to 9.0 wt. % Zn, 0.5 wt. % max. Fe, 0.5 wt. % max. Si, the balance aluminum and incidental impurities;

(b) subjecting said product to a higher first stage aging in a temperature range of 250° to 415° F.; and (c) subjecting said worked body to a lower second stage aging in a temperature range of 100° to 275° F. for a time sufficient to provide said enhanced strength and fracture toughness, the second stage aging starting at a temperature lower than the starting temperature of the higher first stage aging.

44. In a method of providing an aluminum base alloy flat rolled product for air or spacecraft applications, the improvement wherein the product has, in combination, enhanced strength and fracture toughness characteristics and consists essentially of 0.5 to 4.0 wt. % Li, 0.1 to 6.0 wt. % Mg, at least 0.6 wt. % Cu, 0.05 to 12 wt. % Zn, 0 to 0.8 wt. % Mn, 0.15 wt. % max. Zr, 0.05 to 1 wt. % Ag, 0.5 wt. % max. Fe, 0.5 wt. % max. Si, the balance aluminum and incidental impurities, the worked product being provided in a condition resulting from:

(a) providing a worked and solution heat treated body of said aluminum base alloy product;

(b) subjecting said product to a higher first stage aging in a temperature range of 250° to 415° F.; and (c) subjecting said worked body to a lower second stage aging in a temperature range of 100° to 275° F. for a time sufficient to provide said enhanced strength and fracture toughness, the second stage aging starting at a temperature lower than the starting temperature of the higher first stage aging.

45. The method in accordance with claim 44 wherein said second stage aging is in a temperature range of 100° to 275° F.

46. In a method of providing an aluminum base alloy flat rolled product for air or spacecraft applications, the improvement wherein the product has, in combination, enhanced strength and fracture toughness characteristics and consists essentially of 1.0 to 3.0 wt. % Li, 0.6 to 4.0 wt. % Cu, 0.2 to 2.5 wt. % Mg, 0.2 to 11 wt. % Zn, 0.2 to 0.8 wt. % Ag, 0.1 wt. % Mn, the balance aluminum and incidental impurities, the worked product being provided in a condition resulting from:

(a) providing a worked and solution heat treated body of said aluminum base alloy product;

(b) subjecting said product to a higher first stage aging in a temperature range of 250° to 415° F.; and (c) subjecting said worked body to a lower second stage aging in a temperature range of 100° to 275° F. for a time sufficient to provide said enhanced strength and fracture toughness, the second stage aging starting at a temperature lower than the starting temperature of the higher first stage aging.

47. In a method of providing an aluminum base alloy flat rolled product for air or spacecraft applications, the improvement wherein the product has, in combination, enhanced strength and fracture toughness characteristics and consists essentially of 1.8 to 2.5 wt. % Li, 2.50 to 2.9 wt. % Cu, 0.05 to 2.0 wt. % Mg, 0.2 to 2.0 wt. % Zn, 0.1 to 0.7 wt. % Mn, 0.15 wt. % max. Zr, and 0.3 wt. % max. each of Fe and Si, the worked product being provided in a condition resulting from:

(a) providing a worked and solution heat treated body of said aluminum base alloy product;

(b) subjecting said product to a higher first stage aging in a temperature range of 250° to 415° F.; and (c) subjecting said worked body to a lower second stage aging in a temperature range of 100° to 275° F. for a time sufficient to provide said enhanced strength and fracture toughness, the second stage aging starting at a temperature lower than the starting temperature of the higher first stage aging.

48. In a method of providing an aluminum base alloy flat rolled product for air or spacecraft applications, the improvement wherein the product has, in combination, enhanced strength and fracture toughness characteristics and consists essentially of 1.9 to 2.4 wt. % Li, 2.55 to 2.9 wt. % Cu, 0.1 to 0.6 wt. % Mg, 0.5 to 1.0 wt. % Zn, 0.1 to 0.7 wt. % Mn, max. 0.15 wt. wt. % Zr, and max. 0.25 wt. % of each of Fe and Si, the remainder aluminum and incidental impurities, the worked product being provided in a condition resulting from:

(a) providing a worked and solution heat treated body of said aluminum base alloy product;

(b) subjecting said product to a higher first stage aging in a temperature range of 250° to 415° F.; and (c) subjecting said worked body to a lower second stage aging in a temperature range of 100° to 275° F. for a time sufficient to provide said enhanced strength and fracture toughness, the second stage aging starting at a temperature lower than the starting temperature of the higher first stage aging.

49. In a method of providing an aluminum base alloy flat rolled product for air or spacecraft applications, the improvement wherein the product has, in combination, enhanced strength and fracture toughness characteristics and consists essentially of 0.2 to 5.0 wt. % Li, 0 to 5.0 wt. % Mg, up to 5.0 wt. % Cu, 0 to 2 wt.% Ag, 0 to 1.0 wt. % Zr, 0 to 1.0 wt. % Mn, 0 to 9.0 wt. % Zn, 0.5 wt. % max. Fe, 0.5 wt. % max. Si, the balance aluminum and incidental impurities, the worked product being provided in a condition resulting from:

(a) providing a worked and solution heat treated body of said aluminum base alloy product;

(b) subjecting said product to a higher first stage aging in a temperature range of 275° to 350° F. for a period of time in the range of 0.1 to 100 hours; and (c) subjecting said worked body to a lower second stage aging in a temperature range of 100° to 275° F. for a period of time in the range of 1 to 1000 hours to provide said enhanced strength and fracture toughness.

50. In a method of providing an aluminum base alloy flat rolled product for air or spacecraft applications, the improvement wherein the product has, in combination, enhanced strength and fracture toughness characteristics and consists essentially of 0.5 to 4.0 wt. % Li, 0.1 to 6.0 wt. % Mg, at least 0.6 wt. % Cu, 0.05 to 12 wt. % Zn, 0 to 0.8 wt. % Mn, 0.15 wt. % max. Zr, 0.05 to 1 wt. % Ag, 0.5 wt. % max. Fe, 0.5 wt. % max. Si, the balance aluminum and incidental impurities, the worked product being provided in a condition resulting from:

(a) providing a worked and solution heat treated body of said aluminum base alloy product;

(b) subjecting said product to a higher first stage aging in a temperature range of 275° to 350° F. for a period of time in the range of 0.1 to 100 hours; and (c) subjecting said worked body to a second stage aging in a temperature range of 100° to 275° F. for a period of time in the range of 1 to 1000 hours to provide said enhanced strength and fracture toughness.

51. In a method of providing an aluminum base alloy flat rolled product for air or spacecraft applications, the improvement wherein the product has, in combination, enhanced strength and fracture toughness characteristics and consists essentially of 1.0 to 3.0 wt. % Li, 0.6 to 4.0 wt. % Cu, 0.2 to 2.5 wt. % Mg, 0.2 to 11 wt. % Zn, 0.2 to 0.8 wt. % Ag, 0.1 to 0.8 wt. % Mn, the balance aluminum and incidental impurities, the worked product being provided in a condition resulting from:

(a) providing a worked and solution heat treated body of said aluminum base alloy product;

(b) subjecting said product to a higher first stage aging in a temperature range of 275° to 350° F. for a period of time in the range of 0.1 to 100 hours; and (c) subjecting said worked body to a lower second stage aging in a temperature range of 100° to 275° F. for a period of time in the range of 1 to 1000 hours to provide said enhanced strength and fracture toughness.

52. In a method of providing an aluminum base alloy flat rolled product for air or spacecraft applications, the improvement wherein the product has, in combination, enhanced strength and fracture toughness characteristics and consists essentially of 1.8 to 2.5 wt. % Li, 2.50 to 2.9 wt. % Cu, 0.05 to 2.0 wt. % Mg, 0.2 to 2.0 wt. % Zn, 0.1 to 0.7 wt. % Mn, 0.15 wt. % max. Zr, and 0.3 wt. % max. each of Fe and Si, the worked product being provided in a condition resulting from:

(a) providing a worked and solution heat treated body of said aluminum base alloy product;

(b) subjecting said product to a higher first stage aging in a temperature range of 275° to 350° F. for a period of time in the range of 0.1 to 100 hours; and (c) subjecting said worked body to a lower second stage aging in a temperature range of 100° to 275° F. for a period of time in the range of 1 to 1000 hours to provide said enhanced strength and fracture toughness.

53. In a method of providing an aluminum base alloy flat rolled product for air or spacecraft applications, the improvement wherein the product has, in combination, enhanced strength and fracture toughness characteristics and consists essentially of 1.9 to 2.4 wt. % Li, 2.55 to 2.9 wt. % Cu, 0.1 to 0.6 wt. % Mg, 0.5 to 1.0 wt. % Zn, 0.1 to 0.7 wt. % Mn, max. 0.15 wt. wt. % Zr, and max. 0.25 wt. % of each of Fe and Si, the remainder aluminum and incidental impurities, the worked product being provided in a condition resulting from:

(a) providing a worked and solution heat treated body of said aluminum base alloy product;

(b) subjecting said product to a higher first stage aging in a temperature range of 275° to 350° F. for a period of time in the range of 0.1 to 100 hours; and (c) subjecting said worked body to a lower second stage aging in a temperature range of 100° to 275° F. for a period of time in the range of 1 to 1000 hours to provide said enhanced strength and fracture toughness.

* * * * *

UNITED STATES PATENT AND TRADEMARK OFFICE

CERTIFICATE OF CORRECTION

PATENT NO. : 5,076,859

DATED : December 31, 1991

INVENTOR(S) : Roberto J. Rioja and R. Steve James

It is certified that error appears in the above-identified patent and that said Letters Patent is hereby corrected as shown below:

| | |
|---|---|
| Col. 5, line 63<br>Claim 1 | Change "firs" to --first--. |
| Col. 6, line 64<br>Claim 6 | Change "clam" to --claim--. |
| Col. 9, line 8<br>Claim 34 | Change "2.0 wt.T" to --2.0 wt.%--. |

Signed and Sealed this

Sixth Day of April, 1993

*Attest:*

STEPHEN G. KUNIN

*Attesting Officer*

*Acting Commissioner of Patents and Trademarks*